United States Patent [19]

Kellogg et al.

[11] Patent Number: 4,677,840

[45] Date of Patent: Jul. 7, 1987

[54] AUTOMOTIVE BODY TOOL

[75] Inventors: Joseph A. Kellogg, Suisun City; James E. Prather, Fairfield, both of Calif.

[73] Assignee: Non Mar, Inc., Fairfield, Calif.

[21] Appl. No.: 818,585

[22] Filed: Jan. 14, 1986

[51] Int. Cl.[4] ..... B21B 25/00

[52] U.S. Cl. ..... 72/465; 72/476

[58] Field of Search ..... 72/465, 476, 477, 705; 81/21, 463; 267/104.4, 152, 137

[56] References Cited

U.S. PATENT DOCUMENTS

| | | | |
|---|---|---|---|
| 1,506,578 | 8/1924 | Grandahl | 72/477 |
| 1,827,882 | 10/1931 | Cornell | 72/465 |
| 2,314,617 | 3/1943 | Gambino | 72/465 |
| 2,416,916 | 3/1947 | Ferguson | 72/465 |
| 2,518,073 | 8/1959 | Sargent | 72/465 |

*Primary Examiner*—E. R. Kazenske
*Assistant Examiner*—Scott A. Smith
*Attorney, Agent, or Firm*—Lothrop & West

[57] ABSTRACT

A cast iron core provides inertia and a thick rubber covering affords comfort and freedom from marring when a new door skin is installed on a vehicle door framework. The covering over the planar bottom surface of the core is especially thick and serves to absorb and dissipate the impact energy of the body hammer.

6 Claims, 8 Drawing Figures

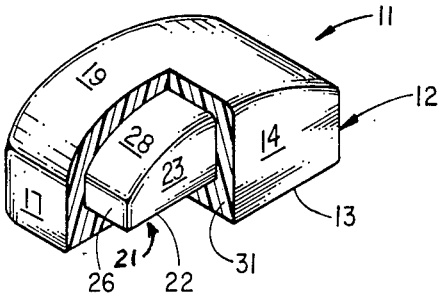
FIG. 1.
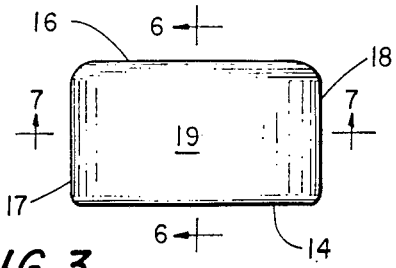
FIG. 3.
FIG. 6.
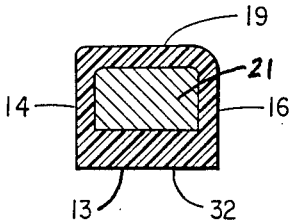
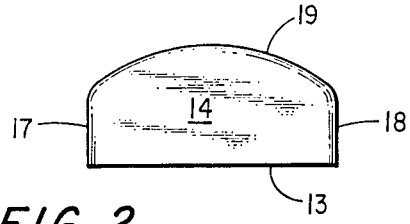
FIG. 2.
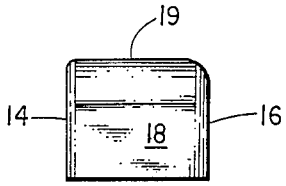
FIG. 5.
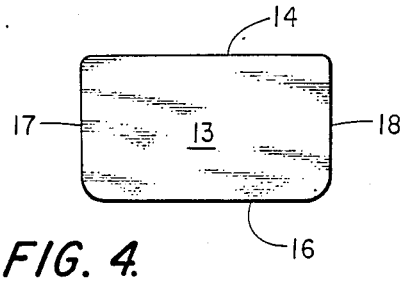
FIG. 4.
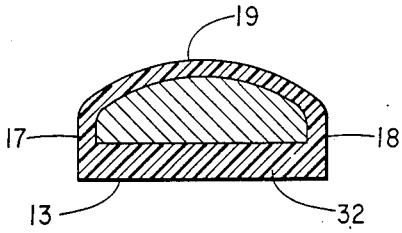
FIG. 7.
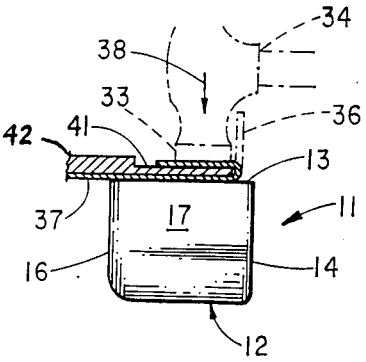
FIG. 8.

AUTOMOTIVE BODY TOOL

BACKGROUND OF THE INVENTION

When installing a new door skin on a vehicle door to replace a door skin damaged in a collision, for example, it is first necessary for the body shop craftsman to remove the old door skin, as by chipping, cutting and abrading it away.

The new door skin, previously cut to size and provided with the customary peripheral anchoring flange at right angles to the skin surface, is first placed on the door framework. Then, the flange is swaged so that the flange is in tight engagement with the peripheral rim of the door framework. The skin is thereby securely mounted on the outside of the door.

Heretofore, the backing members used to support the outer peripheral surface of the door skin during the swaging operation have marred and distorted the thin metal of which the door skin is formed, sometimes to the extent of requiring a coat of body filler around the edge of the skin in order to smooth the surface to an extent acceptable to the customer.

The present tool readily enables the skin to be installed on the door framework without mars and distortions, yet is comfortable to the hand while swaging is effected.

SUMMARY OF THE INVENTION

A hand-held tool includes a body havding a core of heavy material, such as cast iron, to provide inertia, and a covering of elastomeric material, especially thich over the planar bottom portion of the body, for cushioned face to face engagement with a new metal skin being installed on an automobile or truck door framework. The tool is held below, in supporting engagement with the periphery of the new skin, as the skin flange is swaged into horizontal position by a hammer. The downward component of the impact of the descending hammer is absorbed by the inertia of the tool underlying and the elastic covering of the tool not only prevents marring of the thin-gauge metal skin but also makes the tool more comfortable and convenient to hold and use.

PRIOR ART

No pertinent industry publications or prior patents are known to applicants.

BRIEF DESCRIPTION OF THE FIGURES OF THE DRAWING

FIG. 1 is a perspective view of the tool, a portion of the elastomeric covering being broken away to reveal the heavy metallic core:

FIG. 2 is a front elevational view, the rear elevational view being substantially a mirror image thereof;

FIG. 3 is a top plan view;

FIG. 4 is a bottom plan view;

FIG. 5 is an elevational view of one end, the opposite end being a mirror image thereof;

FIG. 6 is a transverse vertical section, the plane of the section being indicated by the line 6—6 in FIG. 3;

FIG. 7 is a median, vertical, longitudinal section, the plane of the section being indicated by the line 7—7 in FIG. 3; and, FIG. 8 is a fragmentary, schematic sectional view, showing the horizontal rim, or edge, of a door framework around which the peripheral flange of a new door skin is being swaged by a hammer, while being hand-supported from below by the tool, shown in end elevation.

DETAILED DESCRIPTION OF PREFERRED EMBODIMENT

Owing to the light gauge of the metal from which the customary automotive door skin is fabricated, it does not take much of an impact to dent and mar and distort the door skin of the average car or truck in the event of a collision or other mishap.

Most car insurance carriers will not pay for replacing a collision-damaged door with a new door. Instead, it is cheaper to have a body shop remove the door from its hinges, cut or chip or grind away the marginal flange securing the old skin to the peripheral edge, or rim, of the door framework, and then install a new skin on the door.

The insurance carrier will usually pay for such replacement of the door skin and, as a consequence, this type of door repair is widely used.

Installation of the new door skin is effected by removing the old, damaged skin and replacing it with a new skin, previously shaped to fit the door of the particular vehicle model being repaired. After positioning the new skin on the outside of the door, an upstanding flange, about an inch high, around the perimeter of the new skin, is swaged onto the door framework by a hammer, starting preferably at one of the corners of the door and working around the entire margin until the new skin is tightly secured to the periphery of the door framework, as appears most clearly in FIG. 8.

Prior to the development of the present tool, body shop workers often supported the underlying surface of the new skin by the palm of the hand when the hammer was pounded against the overlying portion of the flange of the skin and the door rim. This procedure adequately protected the perimeter of the new skin against marring but, before the end of the job the supporting hand was often bruised and sore.

At times, wood sanding blocks, or the like, were utilized; but bouncing of the block with consequent marring or distortion of the new skin was a common occurrence when utilizing this technique, frequently necessitating the addition of a coat or two of auto body filler around the edge of the skin to smooth the surface. This wasted time, effort and money.

We have provided a tool which enables an auto body worker to install a new skin on a car door in approximately half the time as before. It enables the job to be done quickly, comfortably and without marring or distorting the exposed surface of the skin.

The automotive body tool of the invention, generally designated by the reference numeral 11, comprises a block 12, having an external substantially planar bottom surface 13, an upstanding pair of planar side walls 14 and 16, planar end walls 17 and 18, and an arcuate top surface 19 shaped to fit comfortably into a hand of the user.

The block 12 includes a heavy metallic core 21, of cast iron, for example, conforming generally to the external configuration of the block. That is to say, the metal core 21 includes a planar bottom surface 22, a pair of planar side walls 23, a pair of planar end walls 26 and an arcuate top surface 28.

Whereas the cast iron core provides inertia so as to preclude displacement and bouncing as swaging occurs, a thick layer 31 of an elastomeric material, such as rubber having a Durometer 40 hardness, entirely covers the core to prevent marring of the new skin and afford a firm grip on the tool.

The thickness of the rubber layer over the top surface, the side walls and end walls of the core 21 is substantially uniform, being, for example, on the order of $\frac{3}{8}$ of an inch. This thickness has been found to provide a comfortable feel for the user's hand as swaging takes place.

The thickness of the rubber layer 32 covering the bottom 22 of the iron core, however, is on the order of $\frac{3}{4}$ of an inch, twice the thickness of the rubber covering the balance of the core. This additional thickness over the bottom affords a relatively large mass to absorb a part of the dynamic energy imparted by the head 33 of the body hammer 34 as impact occurs, as illustrated most clearly in FIG. 8.

In other words, as the previously vertical flange 36 (shown in broken line in FIG. 8) around the periphery of the new door skin 37 is swaged into a horizontal position (shown in full line in FIG. 8) by appropriately directed blows of the hammer 34, the vertical component 38 of the impact force is partially absorbed by bending the skin flange 36 into horizontal attitude overlying the rim 41 of the door framework 42.

The force then proceeds downwardly, through the rim 41 of the door framework 42 sandwiched between the flange 36 and the adjacent underlying layer of new skin 37, thence into the thick bottom layer 32. Energy is absorbed in the thick bottom layer inasmuch as the inertia of the heavy core 21 prevents displacement. The thick bottom layer 32 is therefore squeezed and flexibly distorted. The rubber molecules are subjected to frictional forces and the absorbed impact energy is transformed to thermal energy. Although measurable, the increase in temperature of the thick, bottom layer of rubber creates no problem since the thermal energy is dissipated back into the overlying, new metal door skin 37 and metal rim 41 of the door framework where, by conduction, the heat is carried away from the impact area.

As can be seen most clearly in FIGS. 3 and 4, the junctions, or corners, are rounded where the end walls 17 and 18, meet one of the side walls, for example, side wall 16. This provides greater comfort when the hand grips the block and also enables the user to position the block to conform, where necessary, to certain rounded contours occasionally encountered in installing a new door skin. There are, in fact, no sharp edge or corners exposed on the external surfaces of the rubber covering and as a result, denting or marring of new door skins is totally eliminated.

What is claimed is:

1. An automotive body tool comprising:

a. a core of iron or similar heavy material having a planar bottom, a pair of longitudinal side walls, a pair of transverse end walls and an arcuate top; and, b. a core covering of elastomeric material having a first predetermined thickness over all surfaces of said core except the bottom, and a second predetermined thickness over the bottom, said second predetermined thickness being approximately twice said first predetermined thickness, said covering having an arcuate top, transverse end walls, longitudinal side walls and a planar bottom for face to face engagement with a planar sheet of automotive door panel material as said sheet is installed on a door framework.

2. A tool as in claim 1 in which said covering is fabricated from rubber having a Durometer hardness of approximately 40.

3. A tool as in claim 1 in which the junctions of said arcuate top and said transverse end walls of said covering are rounded.

4. A tool as in claim 3 in which the junctions of at least one of said longitudinal side walls and said transverse end walls of said covering are rounded.

5. An automotive body tool comprising an elongated ferrous core and an elongated elastomeric covering, said covering including an arcuate top, end walls, side walls and a planar bottom, the thickness of the covering over said bottom being on the order of $\frac{3}{4}$ of an inch and the thickness of the covering over the remainder of the surfaces being on the order of $\frac{3}{8}$ of an inch.

6. An automotive body tool comprising:

a. core of iron or similar heavy material having a bottom, a pair of opposite sides, a pair of opposite ends and a top;

b. a core covering of elastomeric material having a first predetermined thickness over all surfaces of the core except the bottom, and a second predetermined thickness over the bottom, said second predetermined thickness being on the order of twice said first predetermined thickness, said covering having a planar bottom for face to face engagement with a planar sheet of automotive door panel as the sheet is installed on a door framework.

* * * * *